United States Patent [19]

Rogers et al.

[11] 4,196,665

[45] Apr. 8, 1980

[54] PRINTING MACHINE ARRANGEMENTS

[75] Inventors: Neville Rogers, Braintree; Eric A. Blount, Chelmsford; Henry M. Goldstein, London, all of England

[73] Assignee: The Marconi Company Limited, Chelmsford, England

[21] Appl. No.: 871,941

[22] Filed: Jan. 24, 1978

[30] Foreign Application Priority Data

Jan. 26, 1977 [GB] United Kingdom ..... 3058/77

[51] Int. Cl.[2] ..... B41J 7/70

[52] U.S. Cl. ..... 101/66; 101/93.05; 400/124; 400/323

[58] Field of Search ..... 101/66–69, 101/93.04, 93.05; 400/124, 285.5, 320.1, 323, 323.1, 615.2; 346/103, 104, 134, 29

[56] References Cited

U.S. PATENT DOCUMENTS

| | | | |
|---|---|---|---|
| 2,578,771 | 12/1951 | Zint | 400/323 |
| 2,900,066 | 8/1959 | Tholstrup | 400/323 X |
| 3,970,183 | 7/1976 | Robinson et al. | 400/323 X |
| 3,973,661 | 8/1976 | DeBoo et al. | 400/323 X |
| 3,987,884 | 10/1976 | Buxton | 400/615.2 |
| 4,074,067 | 2/1978 | Speckhard | 400/323 X |

OTHER PUBLICATIONS

IBM Tech. Disclosure Bulletin, vol. 18, No. 1, Jun. 1975, D. L. Potak, pp. 265–266.

*Primary Examiner*—Edward M. Coven
*Attorney, Agent, or Firm*—Kirschstein, Kirschstein, Ottinger & Cobrin

[57] ABSTRACT

A ticket printing machine having reversible means for propelling a ticket between two points. The machine has a printing head which is movable transversely to the track of the ticket in a plane parallel to the plane of the ticket. The printing head is driven in steps across the track of the ticket. The arrival of the ticket at either of the two points gives rise to an output signal. Upon the occurrence of such a signal, the ticket is driven in a direction opposite to that at which it arrived at the point and is propelled back toward the other point. The printing head is operative during the traverse of the ticket in either direction to print a line of printing. In addition, when an output signal is generated denoting the arrival of the ticket at one of the points, the printing head is advanced one step across the ticket in readiness for the next line of printing.

19 Claims, 4 Drawing Figures

PRINTING MACHINE ARRANGEMENTS

Figure 1:
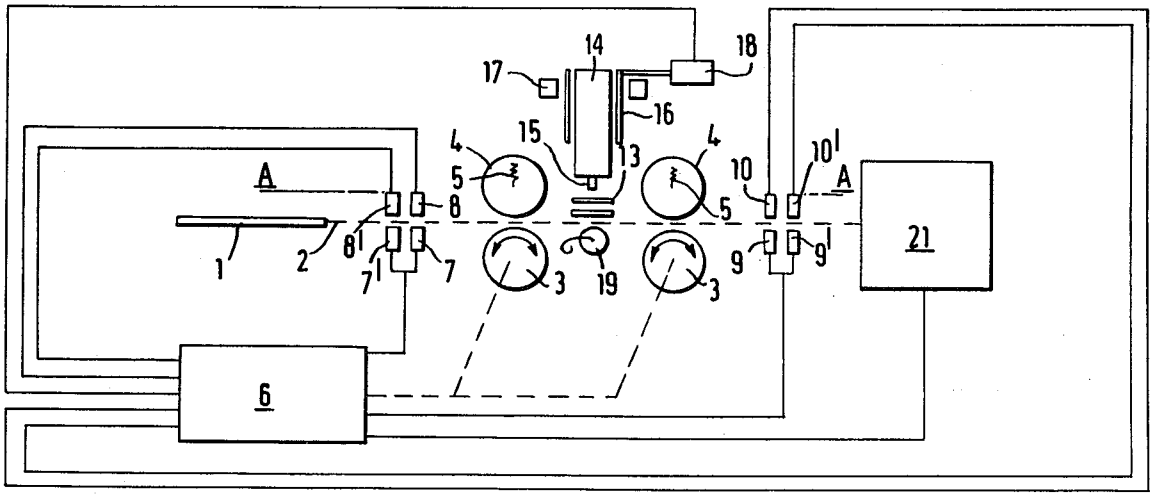

This invention relates to printing machine arrangements and in particular to printing machine arrangements for printing tickets such as railway tickets.

It is commonly required to print tickets such as railway tickets as they are issued to a purchaser. Such tickets require to bear printing some of which is the same for all tickets issued at one station, e.g. the conditions of issue and the identity of the station, and some of which will vary from ticket to ticket, e.g. the identity of the destination, the fare and the date of issue.

One object of the present invention is to provide an improved printing machine arrangement for printing such tickets.

According to this invention a printing machine comprises means for propelling a ticket between two points, a printing head moveable transversely across the track of a ticket between said two points, means for driving said printing head in steps across said track whereby at each step a line of printing may be formed on said ticket, said propelling means being reversible whereby at successive steps the direction of travel of said ticket may be reversed to provide successive movements passed said printing head.

Preferably one of said two points is a ticket input point and the other of said two points is a ticket output point.

Preferably adjacent each of said two points is an optical sensor arrangement provided to sense when at any step said ticket has reached the limit of permissible travel in one direction.

Preferably each optical sensor arrangement comprises two light responsive devices spaced along the length of the track whereby to provide indication of the direction of travel of a ticket.

Preferably between said printing head and the track of a ticket an ink ribbon is passed, the longitudinal axis of said ribbon extending at an angle lying between the direction of the track of said ticket and the direction of transverse movement of said print head whereby step by step said print head operates on portions of said ribbon extending diagonally across the width of said ribbon.

Preferably again said printing head is of the wire matrix type having print needles and a plate is provided on one side of which said ribbon is arranged to pass and on the other side of which said ticket is arranged to pass, said plate having apertures whereby at each step the print needles of said wire matrix printing head may gain access, via said ribbon, to the surface of the ticket to be printed.

Preferably said plate is comprised of a thin sheet of beryllium copper.

Preferably said propelling means comprises a plurality of capstan drive rollers on one side of the track of a ticket each associated with a pinch roller on the other side of said track.

Preferably again the mutual spacing of each capstan drive and pinch roller combination is such that at any time when a ticket is between said two points said ticket is engaged by at least one but not more than two capstan drive and pinch roller combinations.

In a printing machine arrangement including a printing machine as described above a control unit is provided which is arranged to control the stepping of said printing head and the direction of said propelling means in dependence upon sensing means provided to determine when a ticket to be printed has reached the limits of its permissible travel in either direction and sensing means providing data concerning the transverse position of said printing head.

Preferably the number of lines of printing to be formed on said ticket is an odd number and said control unit is arranged so that, following the formation of the last lines of printing on said ticket, the direction of said propelling means is not reversed and said ticket continues to travel away from the input point and beyond the output point.

As will be appreciated, however, the arrangement may be such that the input point also acts as an output point, if for example the number of lines of printing formed on said ticket is even.

According to a feature of this invention the printing machine described above is coupled to and synchronised with an overprinting machine by means of which a printed ticket may be overprinted.

Preferably said overprinting machine comprises a print wheel having a plurality of print positions coupled via a slipping clutch arrangement to a cam, means for propelling a ticket to be overprinted passed said print wheel, and, controlled by said cam, an inking member provided to move towards and away from a print position on said print wheel and a pressure member provided to urge, when said last mentioned print position is adjacent, said ticket towards said last mentioned print position, there being provided means for holding said cam stationary in a datum position against drive via said slipping clutch, means for driving said print wheel together with said cam whereby in operation the latter reaches its datum position and is held with said clutch slipping and said print wheel continuing until a selected datum position is reached depending upon the print position selected, and means timed to the passage of a ticket into said overprinting machine for releasing said cam and causing said print wheel to be driven whereby, in sequence, said selected print position only is inked by said inking member and reaches said pressure member together with said ticket.

Preferably said propelling means comprises a plurality of capstan drive rollers on one side of the track of a ticket through the machine each associated with a pinch roller on the other side of said track. Preferably two capstan drive and pinch roller combinations are provided in said overprinting machine.

Preferably the shafts of said capstan drive rollers are gear driven with said print wheel and the shaft of one of said capstan drive rollers carries said slipping clutch via which said cam is drivable.

Preferably said ink member comprises an ink roller cartridge carried upon one end of a pivoted arm the other end of which carries a cam follower bearing on said cam. Preferably again, said pressure member comprises a pressure roller carried upon one end of a pivoted arm the other end of which carries a cam follower.

Preferably said last mentioned means for holding said cam against drive via said slipping clutch comprises a peg provided on said cam and a lever abutting said peg to prevent movement of said cam against said slipping clutch, means being provided for releasing said lever from said peg whereby to commence rotation said cam with said print wheel at a predetermined time such that said selected print position reaches said pressure member together with a ticket to be over printed.

Preferably said lever is connected to be released as said printing head of said printing machine first mentioned reaches its last step to form the last line of printing upon a ticket. Normally the arrangement is such that said lever is released as said printing head is moving between the penultimate and the last line of printing.

Preferably said print wheel is optically encoded to provide positional information to said control unit and a stepper motor is provided to rotate said print wheel the arrangement being such that after each overprinting operation said print wheel stops at an arbitrary rest datum position from which it is driven to said selected datum position upon selection of a required print position by an operator.

Figure 2:
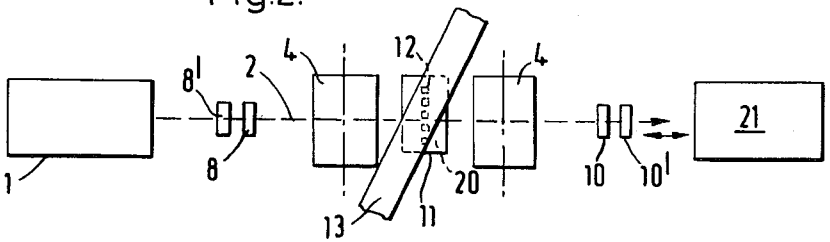
Figure 3:
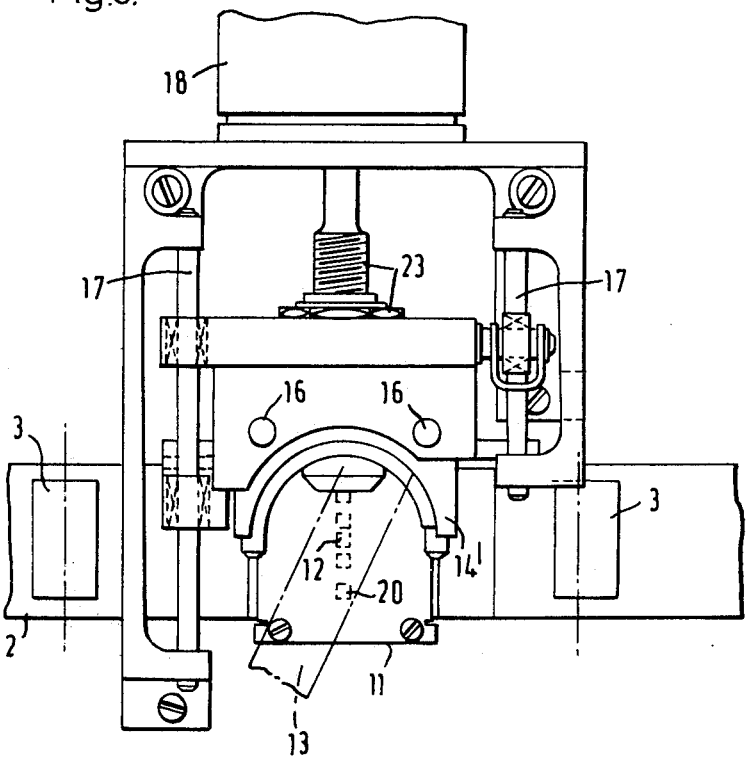
Figure 4:
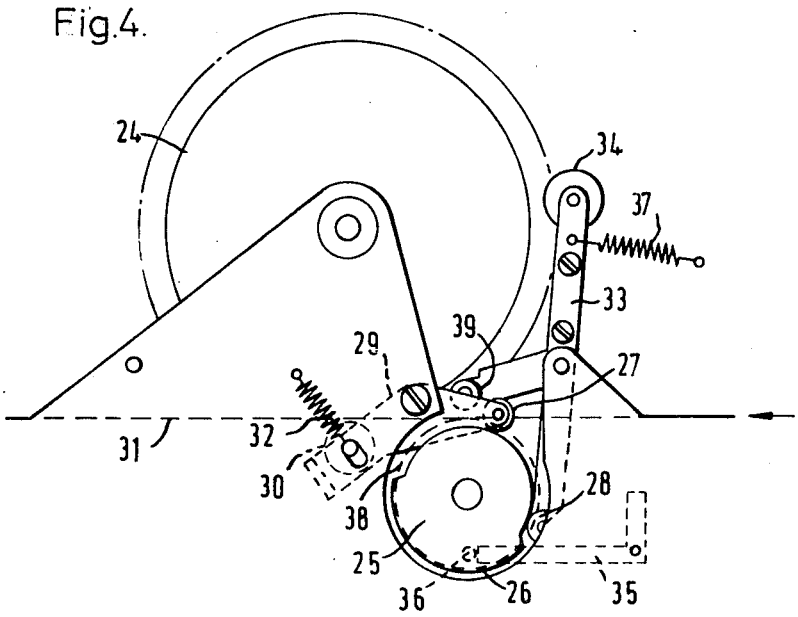

The invention is illustrated in and further described with reference to the accompanying drawings in which, FIG. 1 is a semi-schematic elevation of one printing machine in accordance with the present invention, FIG. 2 is a semi-schematic section along the line AA of FIG. 1 illustrating the arrangement of the inked ribbon, FIG. 3 is a plan view to scale of the printing head region of one practical printing machine in accordance with the present invention and FIG. 4 shows the mechanical arrangement of an over printing machine to which the main printing machine illustrated in FIG. 3 may be coupled.

Referring to FIG. 1, the object is to print five lines of print on an Edmondson sized ticket 1 as favoured for use by British Rail. The ticket 1 is required to have the five lines of print on one side, running longitudinal, the other side of the ticket bearing a magnetic oxide coating.

Positioned along a ticket track 2 are two capstan rollers 3, each associated with a pinch roller 4 on the opposite side of the ticket track 2. The pinch rollers 4 are biassed towards the capstan drive rollers 3 by springs represented at 5. The spacings one from another of the capstan drive and pinch roller combinations 3 and 4 are such that the ticket 1 is always ready in control by at least one combination of capstan drive roller 3 and pinch roller 4, but never more than two. The capstan drive rollers 3 are geared together and driven by a motor (not shown) in synchronism either in a forward direction or a reverse direction under the control of a control unit 6.

At the ticket input end of the signal track 2 is an optical sensor arrangement consisting of a light emitting diode 7 below the track, aligned with a photo-transistor 8 above the track, and further along the track a further light emitting diode 7′ below the track aligned with a photo-transistor 8′ above the track. At the ticket output end of the ticket track 2 is a further optical sensor arrangement consisting of a light emitting diode 9 below the track, aligned with a photo-transistor 10 above the track, and further along the track a further light emitting diode 9′ below the track, aligned with a photo-transistor 10′ above the track. The photo sensitive transistor 8, 8′ and 10, 10′ are connected to supply signals to the control unit 6 showing when the ticket 1 is at one or other end of the signal track 2, and, since the pair of photo-transistors 8, 8′ and 10, 10′ at each end of the track 2 are spaced along the track, the direction of travel of the ticket.

Arranged above the signal track 2, and between the two capstan drive rollers 3 is a beryllium copper sheet 11 having five apertures, represented in dotted outline at 12 in FIG. 2, positioned according to the positions required for the five lines of print to be formed on the ticket 1. Mounted to traverse the copper beryllium sheet 11 is an inked ribbon 13 wound upon two standard spools (not represented).

As best seen from FIG. 2, the ribbon 13 is arranged to traverse the beryllium copper plate 11 at an angle to the line of the apertures 12 so that the line of apertures 12 extends diagonally across the width of the inked ribbon 13.

Mounted above the ribbon 13 is a standard wire matrix print head 14, with its axis vertical and its print needles 15 at its lower end. The wire matrix print head 14 is mounted in vertical slides 16, which permit vertical adjustment of the wire matrix print head, and in horizontal slides 17, which permit the wire matrix print head 14 to traverse the line of apertures 12. The wire matrix print head 14 is driven horizontally within the horizontal slides 17 by a stepper motor 18, so arranged that in a series of five steps the print needles 15 can print sequentially through each individual aperture 12.

Positioned beneath the beryllium copper sheet 11, and on the under side of the ticket track 2, is a spring biassed roller 19, which urges the ticket 1 against the under side of the beryllium copper plate 11 and will accommodate for variations in ticket thickness The operation of the main print machine so far described is as follows, as the ticket 1 is applied to the input of the signal track, photo transistors 8, 8′ provide signals to control unit 6, which causes the capstan drive rollers 3 to rotate in a forward direction. At this stage the horizontal position of the wire matrix print head 14 is such that the print needles 15 are aligned with the first of the series of apertures 12, which first aperture is referenced 20 in FIG. 2. The ticket 1 is engaged by the capstan drive and pinch rollers 3, 4 and passed beneath the beryllium copper sheet 11 whereupon a required first line of print is formed on the ticket 1 by the wire matrix print head 14 under the control of control unit 6. The ticket 1 is driven beneath the beryllium copper sheet 11 until it reaches the output end of the ticket track 2, whereupon signals from photo transistors 10 are passed to the control unit 6, which are utilised by the latter to reverse the direction of rotation of the capstan drive rollers 3. At the same time stepper motor 18 is energised to cause the wire matrix print head 14 to move along the line of apertures 12, until its print needles are aligned with the next aperture. The ticket 1 is then driven backwards beneath the beryllium copper sheet 11, whereupon the wire matrix print head 14, under control of the control unit 6, causes the second line of print to be formed on the ticket 1. The ticket 1 continues to travel in a reverse direction until it again causes signals to be passed from photo transistors 8, 8′ to the control unit 6, whereupon the direction of rotation of the capstan drive rollers 3 is again changed so that they again drive in a forward direction and stepper motor 18 is energised to move the wire matrix print head 14, so that its print needles are now aligned with the next of the apertures 12. The process continues, with the direction of travel of the ticket changing at each print line until the last and fifth line of print is formed upon the ticket, at which time the ticket will be travelling in a forward direction towards the photo transistors 10, 10′ and the output end of the ticket track 2. On this occasion, however, a counter within the control unit 6 having determined that all five lines of print are completed, the direction of rotation of the capstan drive rollers 3 is not reversed and the ticket 1 is passed out of the main printing machine.

The ticket 1 will now be in its fundamental state with the required five lines of print on its surface opposite the magnetic oxide coated surface. The ticket in this state, could, of course, be utilised, but in this instance a further requirement is that the ticket should be over-printed with class and status information, and to this end the ticket is passed along the ticket track 2 to an over printing machine, which is represented by the block 21 in FIGS. 1 and 2, the detailed mechanical arrangement of which will be described later with reference to FIG. 4. The over printing machine 21 is synchronised with the capstan drive rollers 3. Firstly, however, reference will be made to the plan view to scale of the practical main printing machine shown in FIG. 3. In FIG. 3 like references are used for like parts in FIGS. 1 and 2.

Referring to FIG. 3, the wire matrix print head is not shown but it would normally fit into a cradle in the head carrier 14'. The carrier is shown in its mid-position in order to illustrate the arrangement of the apertures 12 in the beryllium copper sheet 11. It will be noted that the apertures 12 in this example are not equally spaced. The wire matrix print head carrier 14' is mounted on two cross travelling linear motion rails 17 and driven by the stepper motor 18 via a leadscrew and nut arrangement 23.

The wire matrix print head carrier 14' is carried on vertical slideways 16 to permit setting up adjustment of the wire matrix print head in a vertical direction above the beryllium copper sheet 11.

In FIG. 3, the inked ribbon 13 is represented in dotted outline in order that the detail of the beryllium copper sheet 11 may be seen.

The ribbon 13, as has already been mentioned, is wound on to standard spools (not shown). Whilst no detail is illustrated, the direction of travel of the ribbon is determined by a mechanical flip flop controlling a switch which energises one or other of a pair of electromagnetic clutches providing winding on drive for one or other of the spools. The armature of each clutch carries spigots which engage with holes in the spools. The spool shafts carrying the rotors of the electro-magnetic clutches are driven via gears by a motor which is arranged to rotate in one direction only. Reversal of ribbon direction, as a take-up spool becomes empty is effected under the control of a switch actuated by an arm operated by eyelets positioned shortly (e.g. 40 to 60 centimeters) before each extreme end of the ribbon.

In order to position the wire matrix print head accurately with respect to each of the apertures 12, optical sensors (again not shown) are provided, which monitor the transverse movement of the wire matrix print head. Positional information thereby derived is passed to the control unit 6, which controls stepper motor 18 accordingly.

The overprinting machine coupled to the main printing machine and represented by the block 21 in FIGS. 1 and 2 will now be described with reference to the mechanical arrangement shown in FIG. 4.

The overprinting machine consists of a print wheel 24 having six print positions on its periphery at which type faces are provided. Each print position relates to a different class/status overprint.

The print wheel 24 is geared to two shafts each carrying a capstan roller 38 and the unit is driven by a stepper motor. The characteristics of this stepper motor are similar to those of the motor driving the capstan drive rollers 3 of the main printing machine. Further, the gearing between the motors and their respective capstan drive rollers is similar for both the main printing machine and the overprinting machine. Further, the diameters of the capstan drive rollers for both printing machines is similar. These design criteria are to ensure that the ticket will enter the overprinting machine at the same speed as it leaves the main printing machine. The stepper motor and one of the capstan drive rollers is not shown in FIG. 4. For each capstan roller 38 there is a pinch roller 39. The capstan rollers are positioned with their axes below the ticket track 31 but with the top surface slightly above the track. Their axial spacing is less than a tickets length, so that ticket control is maintained during passage of the ticket through the overprinter machine. The print wheel 24 is positioned with its axis above the track and is arranged so that its printing surface is at a distance above the track such as to allow a ticket to pass along the track beneath the printing surface without touching the printing surface. To accommodate tickets with a slight convex curvature of the ticket surface to be printed, a light spring pressure is applied to the ticket surface in the vicinity of the print wheel to ensure that any information on the print wheel that is not required to be printed on the ticket, will not be printed. The print wheel rotates in a clockwise direction only, as viewed in FIG. 4.

Capstan rollers, print wheel and gearing are designed so that the surface speed of the rollers and print wheel within the overprinting machine is the same.

A cam 25 is rigidly attached to a mechanical slipping clutch 26 which is carried on one of the capstan drive shafts. The arrangement permits the capstan rollers 38 and the print wheel which is geared to them, to be rotated while the cam 25 is being restrained by a lever 35 abutting a peg 36 with the clutch 26 slipping. When the cam is unrestrained no slip occurs between clutch and cam and the cam is free to rotate at the same angular velocity as the capstan drive rollers.

The print wheel shaft carries an optical encoder (not shown). After the passage of each ticket through the overprinting machine, information from the control unit 6 drives the optical encoder, and also therefore the print wheel 24 to an arbitrary datum position. The cam 25 stops at its datum position with peg 36 carried by cam 25, abutting against a lever 35, hereinafter referred to as the priming lever.

The cam 25 is provided with two cam followers 27 and 28. Cam follower 27 is carried by pivoted lever 29 carrying at its other end a pressure roller 30. A spring 32 is provided both to urge the cam follower 27 against the cam and the pressure roller 30 towards the print wheel.

When the lobe of the cam 25 bears on the cam follower 27 the pressure roller 30 moves downwardly away from the print wheel 24. Cam follower 28 is carried on a pivoted lever 33 carrying at its other end an ink roller cartridge 34. When the lobe of the cam 25 contacts cam follower 28 the inked roller cartridge 34 is urged towards the surface of the print wheel 24 so as to charge the same with ink. A spring 37 is provided both to urge the cam follower 28 against the cam 25 and to pull the inking roller 34 away from the print wheel 24.

The priming lever 35 is mechanically linked to the wire matrix print head carriage 14' of the main printing machine, so that priming lever 35 disengages cam peg 36 as the wire matrix print head carriage moves from penultimate line position to the last line positions.

Printing from the class/status print wheel 24 takes place as follows.

While the ticket is making repeated passes through the main printing machine, operator selection of the particular segment of overprint required, energises the print wheel stepper motor, and the print wheel 24 rotates in a clockwise direction. Rotation continues until parity between encoded position and operator command is achieved at which instant the print wheel stops. This position is regarded as the selected datum for the particular class/status overprint demanded. This action occurs before the matrix print head reaches its last line position and therefore the cam 25 has been prevented from rotating because the priming lever 35 is engaged with cam peg 36.

The correct angular relationship between cam 25 and print wheel 24 has now been made.

As has already been mentioned in connection with the main printing machine as the last line of print is formed on the ticket 1 by the main printing machine the capstan drive rollers 3 are not reversed as the ticket reaches the output of the main printing machine and the ticket 1 continues out of the main printing machine and into the overprinting machine. Sensors at the track indicate when a ticket is about to enter the overprinting machine. This information is sent to the control unit 6 and the print wheel stepper motor is energized. Synchronisation of the print wheel 24 and the overprinting machine with the capstan drive rollers 3 of the main printing machine is such that, from the aforementioned selected datum position, the ink roller cartridge 24 inks only the required class/status overprint, which reaches the pressure roller 30 together with the part of the ticket 1, to be printed. Any part of the ticket 1 which has already passed beneath the print wheel 24 will not touch the print wheel because of the aforementioned light spring pressure which is always applied to the top surface of the ticket whilst in the vicinity of the print wheel 24. As that part of the ticket to be printed moves below that segment of print wheel 24 to be printed, the cam 25 has moved around to such a position that cam follower 27 drops into the dell of the cam. Because spring 32 overcomes the light spring pressure on the surface of the ticket, pressure roller 30 urges the ticket towards the print wheel and the selected class status overprint is printed on the ticket as desired. The position of the overprint on the ticket 1 is of course a function of the timing of the print wheel 24 and the overprinting machine relative to the main printing machine. In practice the five lines of print formed on the ticket by the main print machine covers most of the ticket and the timing of the print wheel 24 of the overprinting machine relative to the cam 25 and the main printing machine ensures that the overprint is applied to the trailing 60% of the ticket.

We claim:

1. A ticket printing machine comprising:

(A) reversible propelling means for propelling a ticket between two points, (B) a printing head, (C) means mounting said head for movement transversely to the track of the ticket in a plane parallel to the plane of the ticket, (D) driving means for driving said printing head in steps across said track of the ticket, (E) sensing means adjacent each of said two points for sensing the presence of the ticket and providing an output signal upon such sensing, (F) control means responsive to an output signal from said sensing means to reverse the operation of said reversible propelling means and the direction of movement of the ticket, (G) said printing head being operative during a traverse of the ticket, in either direction, to print a line of printing, (H) said driving means being responsive to a said output signal from said sensing means to drive the printing head one step across the ticket in readiness for a next line of printing.

2. A machine according to claim 1, wherein each said sensing means comprises two light responsive devices spaced along the length of said track and operative successively by an edge of the ticket for providing an indication of the direction of travel of the ticket. pg,23

3. A machine as claimed in claim 1 and wherein between said printing head and the track of a ticket an ink ribbon is passed, the longitudinal axis of said ribbon extending at an angle lying between the direction of the track of said ticket and the direction of transverse movement of said print head whereby step by step said print head operates on portions of said ribbon extending diagonally across the width of said ribbon.

4. A machine as claimed in claim 3 and wherein said printing head is of the wire matrix type having print needles and a plate is provided on one side of which said ribbon is arranged to pass and on the other side of which said ticket is arranged to pass, said plate having apertures whereby at each step the print needles of said wire matrix printing head may gain access, via said ribbon, to the surface of the ticket to be printed.

5. A machine as claimed in claim 4 and wherein said plate is comprised of a thin sheet of beryllium copper.

6. A machine as claimed in claim 1 and wherein said propelling means comprises a plurality of capstan drive rollers on one side of the track of a ticket each associated with a pinch roller on the other side of said track.

7. A as claimed in claim 6 and wherein the mutual spacing of each capstan drive and pinch roller combination is such that at any time when a ticket is between said two points said ticket is engaged by at least one but not more than two capstan drive and pinch roller combinations.

8. A printing machine arrangement comprising a printing machine according to claim 1 coupled to and synchronized with an overprinting machine by means of which a printed ticket may be overprinted.

9. An arrangement as claimed in claim 8 and wherein said overprinting machine comprises a print wheel having a plurality of print positions coupled via a slipping clutch arrangement to a cam, means for propelling a ticket to be overprinted passed said print wheel, and, controlled by said cam, an inking member provided to move towards and away from a print position on said print wheel and a pressure member provided to urge, when said last mentioned print position is adjacent, said ticket towards said last mentioned print positions, there being provided m ans for holding said cam stationary in a datum position against drive via said slipping clutch, means for driving said print wheel together with said cam whereby in operation the latter reaches its datum position and is held with said cluth slipping and said print wheel continuing until a selected datum position is reached depending upon the print position selected, and means timed to the passage of a ticket into said over printing machine for releasing said cam and causing said print wheel to be driven whereby, in sequence, said selected print position only is inked by said inking member and reaches said pressure member together with said ticket.

10. An arrangement as claimed in claim 9 and wherein said propelling means comprises a plurality of capstan drive rollers on one side of the track of a ticket through the machine 21 each associated with a pinch roller on the other side of said track.

11. An arrangement as claimed in claim 10 and wherein two capstan drive and pinch roller combinations are provided in said overprinting machine.

12. An arrangement as claimed in claim 10 and wherein stepper motors with similar characteristics are used for the capstan drive rollers in the main printing machine and the overprinting machine.

13. An arrangement as claimed in claim 10 and wherein the shafts of said capstan drive rollers are gear driven with said print wheel and the shaft of one of said capstan drive rollers carries said slipping clutch via which said cam is drivable.

14. An arrangement as claimed in claim 9 and wherein said ink member comprises an ink roller cartridge carried upon one end of a pivoted arm 33 the other end of which carries a cam follower bearing on said cam.

15. An arrangement as claimed in claim 9 and wherein said pressure member comprises a pressure roller carried upon one end of a pivoted arm the other end of which carries a cam follower.

16. An arrangement as claimed in claim 15 and wherein said last mentioned means for holding said cam against drive via said slipping clutch comprises a peg provided on said cam and a lever abutting said peg to prevent movement of said cam against said slipping clutch 26, means being provided for releasing said lever from said peg whereby to commence rotation of said cam with said print wheel at a predetermined time such that said selected print position reaches said pressure member together with a ticket to be over printed.

17. An arrangement as claimed in claim 16 and wherein said lever is connected to be released as said printing head of said main printing machine first mentioned reaches its last step to form the last line of printing upon a ticket.

18. An arrangement as claimed in claim 17 and wherein the arrangement is such that said lever is released as said printing head is moving between the penultimate and the last line of printing.

19. An arrangement as claimed in claim 9 and wherein said print wheel is optically encoded to provide positional information to said control unit and a stepper motor is provided to rotate said print wheel; the arrangement being such that after each over printing operation said print wheel stops at an arbitrary rest datum position from which it is driven to said selected datum position upon selection of a required print position by an operator.

* * * * *